US010890408B2

(12) United States Patent
Liu et al.

(10) Patent No.: US 10,890,408 B2
(45) Date of Patent: Jan. 12, 2021

(54) SIMULATED TRAINING AMMUNITION AUTOMATIC LAUNCHING SYSTEM

(71) Applicant: Dongsong Liu, Shenyang (CN)

(72) Inventors: Dongsong Liu, Shenyang (CN); Chunsong Liu, Shenyang (CN); Mingyan Liu, Shenyang (CN)

( * ) Notice: Subject to any disclaimer, the term of this patent is extended or adjusted under 35 U.S.C. 154(b) by 0 days.

(21) Appl. No.: 16/618,393

(22) PCT Filed: May 31, 2018

(86) PCT No.: PCT/CN2018/089178

§ 371 (c)(1),
(2) Date: Dec. 1, 2019

(87) PCT Pub. No.: WO2018/223883

PCT Pub. Date: Dec. 13, 2018

(65) Prior Publication Data

US 2020/0182581 A1 Jun. 11, 2020

(30) Foreign Application Priority Data

Jun. 5, 2017 (CN) ..... 2017 1 0413569

(51) Int. Cl.
*F41A 33/04* (2006.01)
*F42B 8/16* (2006.01)
*F42B 8/20* (2006.01)

(52) U.S. Cl.
CPC ..... *F41A 33/04* (2013.01); *F42B 8/16* (2013.01); *F42B 8/20* (2013.01)

(58) Field of Classification Search
CPC ..... F42B 8/16; F42B 8/20; F41A 33/04
(Continued)

(56) References Cited

U.S. PATENT DOCUMENTS 2,801,586 A * 8/1957 Mongello ..... F41A 33/00 102/529
2,809,624 A * 10/1957 Becher ..... F41B 11/62 124/77

(Continued)

FOREIGN PATENT DOCUMENTS

CN 2650057 * 6/2003
CN 202802607 * 3/2013

(Continued)

*Primary Examiner* — Joshua E Freeman
(74) *Attorney, Agent, or Firm* — IPR Works LLC

(57) ABSTRACT

The invention provides an automatic launching system for simulated training ammunition. It can mimic the effect of explosive detonation in close quarters battles without causing any casualties, and can ignite the fuze and launch the simulated training ammunition without gunpowder involved. The technical solution of the invention is that: the automatic launching system for simulated training ammunition comprises a launcher, a controller and a simulated training ammunition loaded inside the launcher. The Simulated training ammunition comprises an outer shell, a core and a fuze structure at the bottom of the simulated training ammunition. The piston cylinder of the launcher comprises vents in the cylinder sidewall for communicating the cylinder cavity with the launcher cavity. The lower part of the cylinder is connected to a high-pressure gas holder through a pipeline and a normally closed solenoid valve. This invention can automatically identify the target and ignite the fuze and launch the simulated training ammunition after identifying the target, and mimic explosion effects. It uses no gunpowder, thus has no potential safety risks, and is safe, reliable, easy to operate, simple in structure, and suitable for civil production and manufacturing.

5 Claims, 3 Drawing Sheets

(58) Field of Classification Search
USPC ..... 102/498
See application file for complete search history.

(56) References Cited

U.S. PATENT DOCUMENTS 2,955,585 A * 10/1960 Friedland ..... F41B 11/62 124/73
2,960,083 A * 11/1960 Grimland ..... F41A 33/00 124/73
3,088,225 A * 5/1963 Amistadi ..... F41A 21/10 434/24
3,114,318 A * 12/1963 Barnes, Jr. ..... F41F 3/04 102/348
3,238,642 A * 3/1966 Ohlund ..... G09B 9/003 434/16
4,217,717 A * 8/1980 Canty ..... F41A 33/04 102/200
4,245,403 A * 1/1981 Hipp ..... F42B 4/24 102/355
4,697,524 A * 10/1987 Penner ..... F42B 8/20 102/498
4,711,180 A * 12/1987 Smolnik ..... F42B 8/10 102/445
6,059,573 A * 5/2000 Patel ..... F41G 3/30 434/16
6,193,517 B1 * 2/2001 Lazecki ..... F42B 8/20 434/12
9,797,677 B2 * 10/2017 Willett ..... F41B 11/71
10,352,655 B2 * 7/2019 Reymann ..... F42B 30/12
10,690,446 B2 * 6/2020 Reymann ..... F41G 3/30
2016/0238344 A1 * 8/2016 Jandl ..... F42B 8/20
2018/0364006 A1 * 12/2018 Reymann ..... G01R 33/072
2019/0285384 A1 * 9/2019 Reymann ..... F41A 33/00

FOREIGN PATENT DOCUMENTS

CN 104457408 * 3/2015
CN 105115357 * 12/2015

* cited by examiner

SIMULATED TRAINING AMMUNITION AUTOMATIC LAUNCHING SYSTEM

FIELD OF THE INVENTION

This invention relates to a simulated combat training system, and especially an automatic launching system for simulated training ammunition. It is used for the simulated combat training for troops and police soldiers by firing simulated training ammunitions at the trainees.

BACKGROUND OF THE INVENTION

Currently, military training includes close combat, which is taking place within several meters to tens of meters, also known as Close Quarters Battle (CQB). In CQB, weapons and ammunition such as mortars and rifle grenades, causing damages mainly in the form of shrapnel produced from the explosion, are heavily used. In order to simulate a more truthful battlefield during the training, transmitters with a launcher are usually used for transmitting the training ammunition. For example, training ammunitions having only the appearance of a mortar shell and without explosives in the warhead are fired by mortars. For another example, training ammunitions having only the appearance of a grenade and without explosives in the warhead are fired by grenade launchers mounted under the barrel of a rifle.

The device can ignite the gunpowder in the launcher to generate bore pressure to push the warhead. Gunpowder is disposable and expensive. Gunpowder does harm to the environment and poses safety hazards to surrounding people. And because of the fact that practice bombs have no explosive in the warheads, there will be no explosion effect. Therefore, it is difficult to immerse soldiers in the sights and sounds of real combats. Furthermore, In the live-fire shooting training, the side as the enemy needs to fire the training ammunitions to the trainees of our side for simulated attack, and the trainees respond with live ammunition. To reduce injuries, frontal attack of the two sides is not allowed, which makes the training inauthentic. As a result, it is normal to plant explosives in advance, set off them to mimic the effect of bomb blasts. But the explosion can cause safety hazards to personnel, property and environment, and the cost of security measures remains high.

Furthermore, explosives must be planted by professionals. It takes plenty of manpower, material and financial resources to put detonating cables between live fire training area and safely operation region, and set up warning marks of explosion sites and blast radius, and so on. Trainees will prepare mentally and even take evasive action or walk around them on the sight of the warning marks, which makes the training lack of suddenness and unpredictability. The ignition of the explosives must be monitored and operated by the professionals on the scene. It is difficult to form an easy operation and cooperative control training system because the training field is crowded with numerous personnel, vehicles, arms, ammunition and miscellaneous equipment. Besides, products with gunpowder, for security reasons, find difficulties in large scaled civil production.

SUMMARY OF THE INVENTION

The aim of this invention is to provide an automatic launching system for simulated training ammunition. The invention can mimic the effect of explosive detonation in close quarters battles without causing any casualties. Also, it can automatically recognize the targets, fire and detonate ammunition without gunpowder involved.

The technical solution of the invention is as follows:

In accordance with an aspect of the present invention there is provided an automatic launching system for simulated training ammunition comprising a launcher, a controller and a simulated training ammunition loaded inside the launcher, wherein the simulated training ammunition comprises an outer shell, a core and a fuze structure at the bottom of the simulated training ammunition.

The launcher comprises a supporting ring inside the launcher to support the outer shell and a piston cylinder below the supporting ring inside a cavity of the launcher, wherein the piston cylinder comprises: a punch at the upper part of the piston for impacting the fuze structure; vents in the cylinder sidewall for communicating the cylinder cavity with the launcher cavity, a seal end at the lower part of the piston to isolate the cylinder cavity from the launcher cavity by moving back and forth to the position lower than the vents and to communicate the cylinder cavity with the launcher cavity by moving back and forth to the position higher than the vents, the lower part of the cylinder being connected to a high-pressure gas holder through a pipeline and a normally closed solenoid valve.

The controller comprises a computer which is connected to a video camera to receive video data from the video camera and identifying target image of the video data by comparing with a pre-stored target image, and which is connected to a normally closed solenoid valve through a microcontroller so that the computer sending instructions to the microcontroller through a control port to control the switching action of the normally closed solenoid valve, the shooting direction of lens of the video camera being the same as that of the launcher, the target image being a marker.

The core comprises a high-pressure gas seal bottle with a sleeve, a interlayer between the outer shell made of a thin-walled plastic bottle and the sleeve being filled with dispersible fine powder, the fuze structure comprising a fuze cap that is sealed and connected to the outer shell, wherein the fuze cap comprises an annular step with internal threads on it in the inner opening of the fuze cap wherein the internal threads being non-sealing thread connected with the sleeve; a tip cone with a base at the bottom of the fuze cap for puncturing the high-pressure gas seal bottle; an end cover pressed against the outer port of the fuze cap by a return spring, wherein the base of the tip cone is connected with the end cover of the fuze cap through a bolt and is pressed against the internal bottom of the fuze cap, the tip of the tip cone in proximity to the thin-walled head of the high-pressure gas seal bottle, the outside diameter of the fuze cap is less than the inside diameter of the supporting ring of the launcher.

In an embodiment, the system comprises a bullet-proof case containing the launcher and the controller and a periscope corresponding to lens of the video camera.

In an embodiment, the periscope has a two-section structure with a threaded interface, and the objective lens is in the upper part of the two-section structure, and the eyepiece lens is in the lower part.

In an embodiment, the bullet-proof case comprises a bullet-proof steel plate placed behind the objective lens of the periscope.

In an embodiment, the vents are a number of through-holes on the same circumference in proximity to the top of the cylinder, the seal end of the piston has the shape of a column and has an axial thickness less than the distance between the vents and the top of the cylinder.

The invention has the advantages as follows:

The invention adopts the launcher with a cylinder type ejection component to trigger a fuze structure of the simulated training ammunition. The simulated training ammunition are launched by high-pressure gas, by which pushes the piston punch cleverly to impact the fuze cap. Connection of the vents is controlled by the seal end of the piston to export high-pressure gas to push the training ammunition out of the launcher without gunpowder. Therefore, the risk of firing gunpowder in the launcher is avoided. The training ammunitions are launched by the energy storage and kinetic energy release of the cylinder. Gunpowder is disposable and expensive. It does harm to the environment. On the contrary, elastomer components can be used safely, repeatedly, and expediently, and they are maintenance-free and cheap.

The training ammunition uses a high-pressure gas seal bottle as the core. The fuze structure is impacted to puncture the thin-walled head of the high-pressure gas seal bottle. Then the compressed gas is released through the gap of the non-sealing threads of the annular step, and fills the interlayer between the outer shell and the sleeve. The thin-walled plastic bottle fails to bear the air pressure and explodes with an explosive sound. In the meantime, fine powder that is filled between the outer shell and the sleeve is released as smoke. The structure is a safe ammunition without gunpowder and explosion fragments. It is safe for personnel and property, and it uses no expensive and dangerous gunpowder, and also protects the environment. This invention solves the problem that fuze relies heavily on gunpowder. And it can both activate the fuze and launch bomb by a single launch.

The controller can capture by a video camera and identify by a computer the target image. The invention combines optical observation with computer vision technology. It can automatically search and identify the target and launch the ammunitions after identifying the target. Due to the cancel of the field control or remote control, manpower is saved and auto-run without people can be achieved. The invention can be placed anywhere in the training area without any security risks.

Over all, this invention can automatically identify the trainees and launch training ammunitions after identifying the target, and mimic explosion effects. It uses no gunpowder, thus has no potential safety risks, and is safe, reliable, easy to operate, simple in structure, and suitable for civil production and manufacturing.

BRIEF DESCRIPTION OF THE DRAWINGS

The invention will be further described below in accompany with the following drawings.

The serial number in the figure is explained as follows: 1. launcher, 2. video camera, 3. periscope, 4. computer, 5. bullet-proof case, 6. normally closed solenoid valve, 7. high-pressure gas holder, 8. supporting ring, 9. Piston, 9-1. Punch, 9-2. seal end, 10. Cylinder, 11. cylinder cavity, 12. fuze structure, 13. High-pressure gas, 14. pipeline, 15. air inlet, 16. Vent, 17. launcher cavity, 18. simulated training ammunition, 19. outer shell, 20 fine powder, 21. sleeve 22. high-pressure gas seal bottle, 23. fuze cap, 24 annular step, 24-1. internal threads, 25. tip cone, 25-1. tip of the tip cone, 26. bottom with through-hole, 27. return spring, 28. end cover, 29. Bolt.

DESCRIPTION OF EMBODIMENTS

Figure 1:
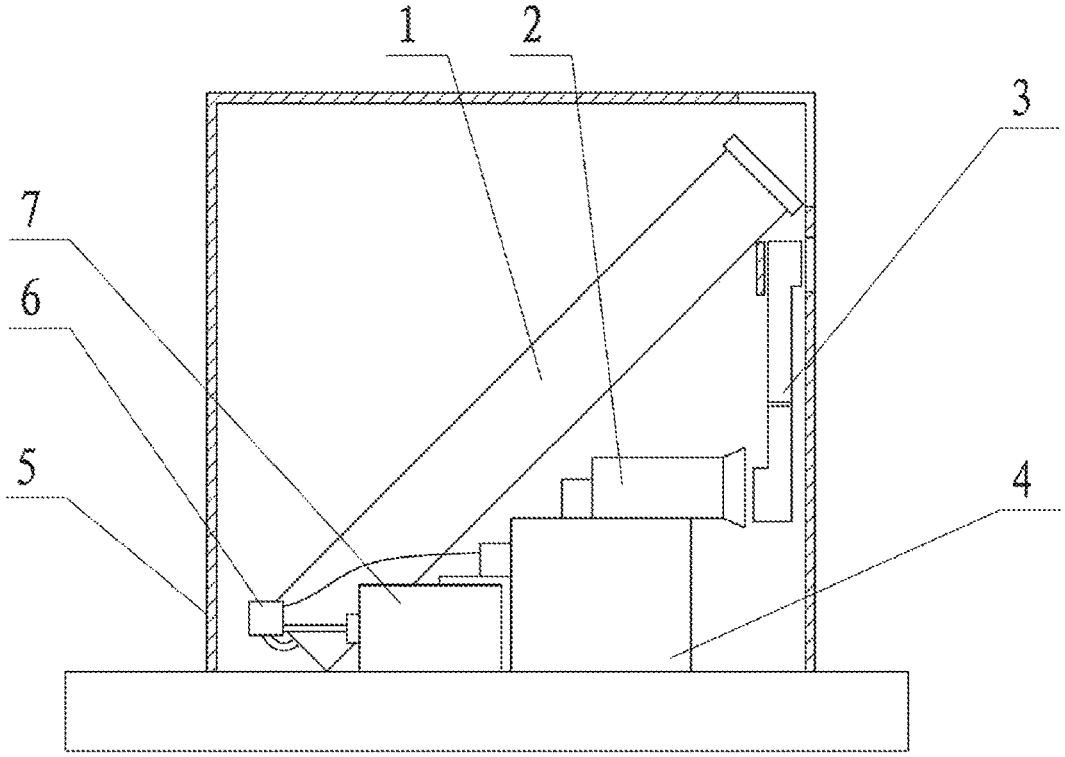
FIG. 1 is a structural schematic diagram of an embodiment of the invention.

Now the invention is further described in accompany with FIGS. 1-5. The embodiment shown in FIG. 1 is an automatic launching system for simulated training ammunition. It comprises a launcher 1, a simulated training ammunition for loading inside the launcher and a controller. The controller comprises a computer 4 for identifying images, which is connected to a video camera 2. The computer 4 is also connected to a normally closed solenoid valve 6 through a microcontroller. The controller can be powered by batteries. A bullet-proof case 5 can be set outside the launcher 1 and the controller. The bullet-proof case can be made of bullet-proof steel plate. The outside of the case is covered with elastic material to prevent bullets from bouncing, which is used to protect the internal components from damage by live ammunition. The bullet-proof case is covered with elastic material to prevent bullets from ricocheting, which is used to protect the internal components from damage by live ammunition. The shooting direction of lens of the video camera is the same as that of the launcher. In order to make the camera lens have a better shooting angle and to prevent damage by live ammunition, a periscope is installed corresponding lens of to the video camera. The objective lens of the periscope is arranged at the shooting port of the bullet-proof case 5.

Figure 2:
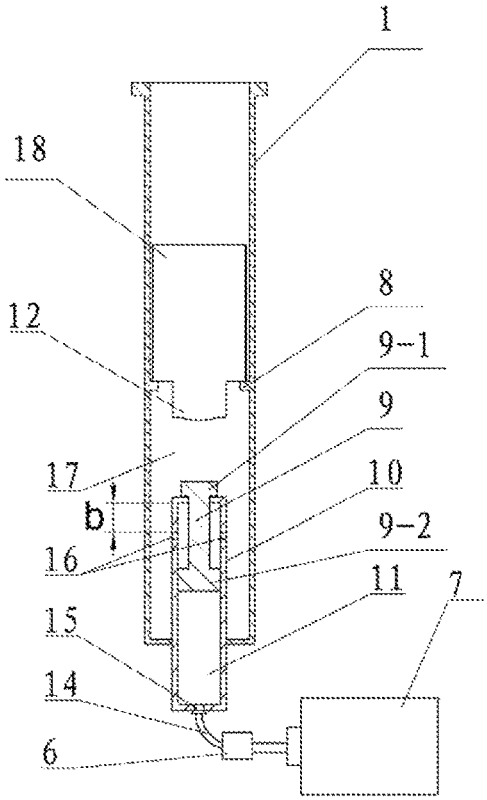
FIG. 2 is a structural schematic diagram of the launcher to be launched.
Figure 3:
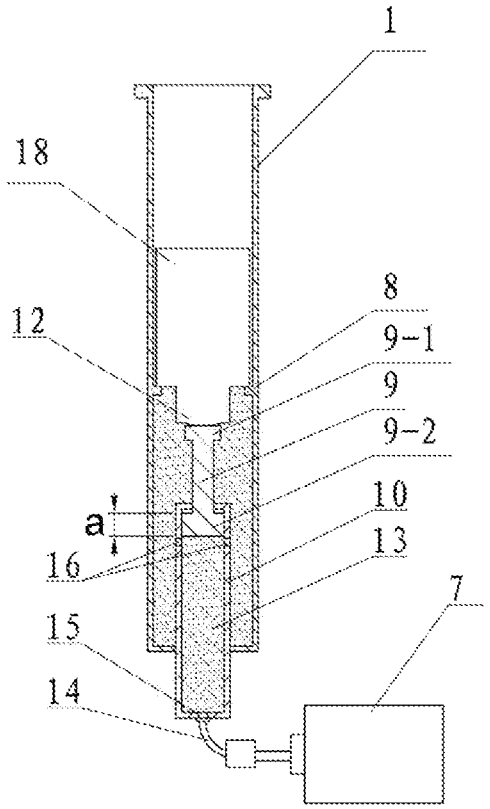
FIG. 3 is a schematic diagram of the launcher filling with gas.

As shown in FIGS. 2 and 3, the launcher 1 comprises a supporting ring 8 for supporting the outer shell inside the launcher. FIG. 2 shows the launcher to be launched. The supporting ring holds up the lower shoulder of the outer shell. the launcher 1 comprises a piston cylinder 10 under the supporting ring inside a cavity of the launcher. the piston cylinder comprises a punch 9-1 at the upper part of the piston 9 to impact the fuze structure 12 and a seal end 9-2 at the lower part of the piston. The seal end can slide against the inner wall of the cylinder. The piston cylinder comprises vents 16 in the cylinder sidewall for communicating the cylinder cavity 11 with the launcher cavity 17. The seal end at the lower part of the piston can isolate the cylinder cavity from the launcher cavity by moving back and forth to the position lower than the vents 16 and can communicate the cylinder cavity with the launcher cavity by moving back and forth to the position higher than the vents. The lower part of the cylinder is connected to a high-pressure gas holder 7 through a pipeline 14 and a normally closed solenoid valve 6. FIG. 3 is a schematic drawing of the launcher filled with gas. The piston 9 slides to the top of the cylinder 10 by the thrust of high-pressure gas so that the punch rise and impact the end cap of the fuze cap of to stimulate the fuze when the high-pressure gas 13 enters the cylinder 10, and the seal end of the piston is blocked in the cylinder after passing by the vents. The vents can be a number of through-holes on the same circumference in proximity to the top of the cylinder. The seal end of the piston has the shape of a column and has an axial thickness a less than the distance b between the vents and the top of the cylinder.

Figure 4:
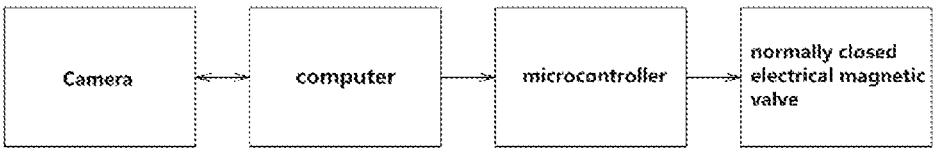
FIG. 4 is a block diagram of the controller.

As shown in FIG. 4, the controller comprises a video camera and a computer for identifying images. The computer is connected to a normally closed solenoid valve through a microcontroller. The computer is connected to a video camera to receive video data from the video camera and identifying target image of the video data by comparing with a pre-stored target image. The target image is a marker. The computer can send instructions to the microcontroller through a control port to control the switching action of the normally closed solenoid valve.

In order to improve the speed and accuracy of recognition, the video camera can be a camera with a high speed of 120-frames-per-second. In order to avoid perspective distortion, the video camera can use a standard lens instead of a wide-angle lens or a telephoto lens. Computer visual image recognition technology has already had the ability to identify faces, license plates and text from video. The computer can use a micro-computer or laptop with the image recognition system, such as computer vision library based on OPENCV (Open Computer Vision). The marker of the target image can be a specific geometric label or an easily recognizable color label. The image feature data of the marker is extracted and stored in the Computer visual image recognition system in advance. For example, the geometric label can be 4 triangular signs (each has a size of 15 cm×15 cm) and the video image data of the geometric label can be stored in computer memory as a template of the target image. The geometric labels are attached to the chest, back and both sides of body of the trainee's clothes. The video data from the video camera can be transmitted to the computer, and then the image recognition system reads each frame of image and compares it with the template of the target image. When the trainee with the labeled clothes shows up in front of the video camera, the marker on the trainee's clothes can be captured by the video camera, and the trainee will be identified as a target if the two sets of data are determined to be consistent after comparing the captured image that contains the same features as the image template with the image template. And then the computer can send an instruction to the microcontroller to control the switching action of the normally closed solenoid valve.

The image recognition system can identify the data of the marker from the real-time video images, namely identifying the target. It is only necessary to identify the presence or absence of the marker in front of the camera lens, and it is not necessary to identify the position, running track and speed of the marker, nor to track the marker. In the meantime, things in the FOV (Field Of View) of the camera can be selected artificially. Other than the marker, nothing in the video captured by the video camera can trigger the launching system.

The periscope has a two-section structure with a threaded interface, and the objective lens is in the upper part of the two-section structure and the eyepiece lens is in the lower part. The upper part can be connected with the lower part through the threaded interface. Pointing the camera lens to the eyepiece lens in the lower part of the periscope, and the shooting direction of the objective lens in the upper part of the periscope is the same as that of the launching port of the launching system. The bullet-proof case has a lid that opens upwards. And the objective lens in the upper part of the periscope is arranged at the shooting port of the bullet-proof case. The port of launcher is arranged at the launching port of the bullet-proof case. A bullet-proof steel plate can be vertically installed behind the eyepiece lens and the bullet-proof steel plate can be welded to the lower surface of the lid of the bullet-proof case. During the live-fire training, the launching port, which is made of steel, can not be damaged if it is hit by live ammunition. The vertical bullet-proof steel plate behind the eyepiece lens can prevent bullets from continuing to puncture the interior of the case and damage other structures when the objective lens is damaged. If it happens, it is only necessary to remove the objective lens from the threaded joint of the periscope and replace it with a new one, and this is convenient and cheap. Such structure uses an objective lens to avoid the damage of the expensive camera, which not only saves the operation and maintenance cost of the system, but also realizes rapid repair, thus ensuring the realizability and stability continuity of actual combat military training for the army. The bullet-proof case can also be a suitcase with a built-in battery. Therefore, the invention is an independent and complete closed loop system that can be placed anywhere.

Figure 5:
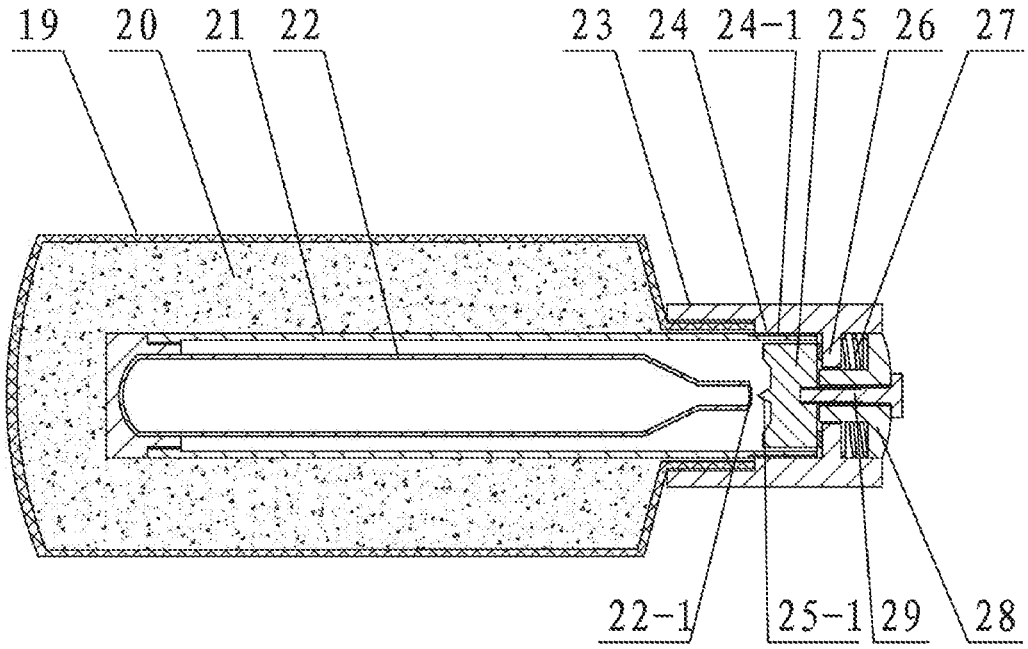
FIG. 5 is a structural schematic diagram of the simulated training ammunition.

As shown in FIG. 5, the simulated training ammunition comprises the outer shell 19 made of a thin-walled plastic bottle that can burst under conditions of high internal pressure and a core that comprises a high-pressure gas seal bottle 22 with a sleeve 21. The high-pressure gas can include at least one or a mixture of air, CO2 and N2. A interlayer between the outer shell and the sleeve is filled with dispersible fine powder 20. The fine powder can include at least one of fine carbon powder, fine pulverized coal and fine talc powder. The fine powder can be released to form a smoke similar to explosion when the outer shell bursts. The fuze structure comprises a fuze cap 23 at the bottom of the outer shell. The fuze cap is tightly coupled to the bottom opening of the outer shell through the internal thread on the inside opening. The outside diameter of the fuze cap is less than the outside diameter of the outer shell. The fuze cap comprises an annular step 24 with internal threads 24-1 on it in the inner opening of the fuze cap. The internal threads can adopt a non-sealed pipe thread which can form a non-sealing threaded coupling of the sleeve of the core. The gap of the threaded coupling can be used to direct the released high-pressure gas into the interlayer space between the outer shell and the sleeve. A tip cone 25 with a base, for puncturing the high-pressure gas seal bottle, is arranged at the bottom of the fuze cap 23. The fuze cap comprises an end cover 28. The end cover of the fuze cap can be pressed against an outer port of the fuze cap by a return spring 27. The base of the tip cone is connected with the end cover of the fuze cap through a bolt 29 and is pressed against the bottom with through-hole 26 of the fuze cap by a sealing gasket 25. The tip of the tip cone 25-1 is in proximity to the thin-walled head 22-1 of the high-pressure gas seal bottle. In use, the release and expansion of the high-pressure gas is the delayed-action of the explosion. The release and expansion of compressed gas can delay the explosion of the outer shell. The delay time can be adjusted by controlling the volume of the fine powder filled between the shell and the sleeve. Normally, the delay time is set to more than 2 seconds to reserve shot and flight time. The volume of the compressed gas expands rapidly under normal pressure, which can causes the pressure from inside to outside to be applied to the inner wall of the outer shell, making the outer shell burst.

The working process of the launcher is as follows: The computer can control the microcontroller to open a solenoid valve at the outlet of the high-pressure gas holder after identifying the target. The high-pressure gas moves the piston upwards when injecting into the cylinder. The punch can rise and impact the end cover of the fuze cap to fire the fuze. The seal end of the piston can cut off the passage between the high-pressure gas and the vents during the first half of the piston's upstroke. The seal end has passed by the vents when the piston hits the end of stroke so that the high-pressure gas can be injected out of the vents and into the launcher cavity when the punch impacts the end cover of the fuze cap. The erupting high-pressure gas can push up the simulated bomb whose fuze has been fired, upward and shoot it from the launcher to the target. At this point, the end cover of the fuze cap indents into the fuze cap and drives the tip of the top cone forward and punctures the high-pressure gas seal cylinder After the impact force disappears, the tip cone is reset under the push of the return spring. And the high-pressure gas is released by the holes, through which the high pressure gas seal cylinder, punctured by the tip cone, gradually filling the interlayer between the outer shell and the sleeve until the pressure that the outer shell can bear is exceeded, produce the explosion sound and smoke to simulate the battlefield. In order to continuously fire bombs, multiple launchers can be connected with the controller, or a loading device can be arranged on the launcher.

By programming the microcontroller, the normally closed solenoid valves is controlled to open for less than 1 second. The normally closed solenoid valve can resume its closed state after the completion of a launch. The high-pressure gas is cut off, and the pressure in the cylinder returns to the normal pressure, and the piston slides down to the initial standby position under the action of gravity, waiting for the next launch.

In conclusion, the purpose of the invention is realized.

What is claimed is:

1. An automatic launching system for simulated training ammunition, comprising a launcher, a controller and a simulated training ammunition loaded inside the launcher, wherein the simulated training ammunition comprises an outer shell, a core and a fuze structure at the bottom of the simulated training ammunition, characterized in that:

the launcher comprising a supporting ring inside the launcher to support the outer shell and a piston cylinder below the supporting ring inside a cavity of the launcher, wherein the piston cylinder comprises: a punch at the upper part of the piston for impacting the fuze structure; vents in the cylinder sidewall for communicating the cylinder cavity with the launcher cavity, a seal end at the lower part of the piston to isolate the cylinder cavity from the launcher cavity by moving back and forth to the position lower than the vents and to communicate the cylinder cavity with the launcher cavity by moving back and forth to the position higher than the vents, the lower part of the cylinder being connected to a high-pressure gas holder through a pipeline and a normally closed solenoid valve;

the controller comprising a computer which is connected to a video camera to receive video data from the video camera and identifying target image of the video data by comparing with a pre-stored target image, and which is connected to a normally closed solenoid valve through a microcontroller so that the computer sending instructions to the microcontroller through a control port to control the switching action of the normally closed solenoid valve, a shooting direction of a lens of the video camera being the same as that of the launcher, the target image being a marker;

the core comprising a high-pressure gas seal bottle with a sleeve, a interlayer between the outer shell made of a thin-walled plastic bottle and the sleeve being filled with dispersible fine powder, the fuze structure comprising a fuze cap that is sealed and connected to the outer shell, wherein the fuze cap comprises an annular step with internal threads on it in the inner opening of the fuze cap wherein the internal threads being non-sealing thread connected with the sleeve; a tip cone with a base at the bottom of the fuze cap for puncturing the high-pressure gas seal bottle; an end cover pressed against the outer port of the fuze cap by a return spring, wherein the base of the tip cone is connected with the end cover of the fuze cap through a bolt and is pressed against the internal bottom of the fuze cap, the tip of the tip cone in proximity to the thin-walled head of the high-pressure gas seal bottle, an outside diameter of the fuze cap is less than an inside diameter of the supporting ring of the launcher.

2. The automatic launching system for simulated training ammunition according to claim 1, is characterized in that the system comprises a bullet-proof case containing the launcher and the controller and a periscope corresponding to the lens of the video camera.

3. The automatic launching system for simulated training ammunition according to claim 2, is characterized that the periscope has a two-section structure with a threaded interface, and an objective lens is in the upper part of the two-section structure, and an objective lens is in the lower part.

4. The automatic launching system for simulated training ammunition according to claim 3, is characterized that the bullet-proof case comprises a bullet-proof steel plate placed behind the objective lens of the periscope.

5. The automatic launching system for simulated training ammunition according to claim 1, is characterized that the vents are a number of through-holes on the same circumference in proximity to the top of a cylinder, the seal end of the piston has a shape of a column and has an axial thickness less than a distance between the vents and the top of the cylinder.

* * * * *